US009115881B2

(12) United States Patent
Kim

(10) Patent No.: US 9,115,881 B2
(45) Date of Patent: Aug. 25, 2015

(54) LIGHTING LAMP

(75) Inventor: Dong Hyun Kim, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 0 days.

(21) Appl. No.: 14/239,755

(22) PCT Filed: Aug. 10, 2012

(86) PCT No.: PCT/KR2012/006388

§ 371 (c)(1),
(2), (4) Date: Feb. 19, 2014

(87) PCT Pub. No.: WO2013/027953

PCT Pub. Date: Feb. 28, 2013

(65) Prior Publication Data

US 2014/0184051 A1 Jul. 3, 2014

(30) Foreign Application Priority Data

Aug. 24, 2011 (KR) ..... 10-2011-0084317

(51) Int. Cl.

| | |
|---|---|
| ***F21V 29/00*** | (2006.01) |
| ***F21V 17/00*** | (2006.01) |
| ***F21K 99/00*** | (2010.01) |
| ***F21V 3/02*** | (2006.01) |
| ***F21V 29/506*** | (2015.01) |
| ***F21V 29/74*** | (2015.01) |
| ***F21V 29/77*** | (2015.01) |
| *F21Y 101/02* | (2006.01) |

(52) U.S. Cl.

CPC ..... *F21V 29/2206* (2013.01); *F21K 9/135* (2013.01); *F21V 3/02* (2013.01); *F21V 29/506* (2015.01); *F21V 29/74* (2015.01); *F21V 29/773* (2015.01); *F21Y 2101/02* (2013.01)

(58) Field of Classification Search

None

See application file for complete search history.

(56) References Cited

U.S. PATENT DOCUMENTS

| | | | | |
|---|---|---|---|---|
| 8,058,782 | B2 * | 11/2011 | Lai | 313/46 |
| 8,072,130 | B2 * | 12/2011 | Wang et al. | 313/318.01 |
| 8,227,968 | B2 * | 7/2012 | Kaandorp et al. | 313/114 |
| 2008/0123341 | A1 | 5/2008 | Chiu | |
| 2009/0046473 | A1 | 2/2009 | Tsai et al. | |
| 2011/0101861 | A1 * | 5/2011 | Yoo | 315/35 |
| 2013/0187528 | A1 * | 7/2013 | Bailey | 313/46 |

FOREIGN PATENT DOCUMENTS

| | | | |
|---|---|---|---|
| KR | 10-0922946 | B1 | 10/2009 |
| KR | 10-0927114 | A1 | 11/2009 |
| KR | 10-0943074 | B1 | 2/2010 |
| KR | 20-2011-0003543 | U | 4/2011 |

OTHER PUBLICATIONS

International Search Report in International Application No. PCT/KR2012/006388, filed Aug. 10, 2012.

* cited by examiner

*Primary Examiner* — Ashok Patel

(74) *Attorney, Agent, or Firm* — Saliwanchik, Lloyd & Eisenschenk

(57) ABSTRACT

A lighting lamp for improving heat dissipation efficiency and preventing life-shorting of an lighting lamp is provided. More specifically, an lighting lamp which comprises a heat sink on peripheral surface of which a first heat transfer flow path is provided, a light emission module provided on the upper plane of the heat sink and provided with at least one light emission element, and a globe connected to the upper part of the heat sink and covering the light emission module, and a second heat transfer flow path provided on outer peripheral surface of the globe and corresponds to the first heat transfer flow path.

14 Claims, 5 Drawing Sheets

(a) (b)

LIGHTING LAMP

CROSS-REFERENCE TO RELATED APPLICATIONS

This application is the U.S. national stage application of International Patent Application No. PCT/KR2012/006388, filed Aug. 10, 2012, which claims priority of Korean Patent Application No. 10-2011-0084317, filed on Aug. 24, 2011, in the Korean Intellectual Property Office, which is hereby incorporated by reference in its entirety.

The present invention relates to a lighting lamp which improves heat dissipation efficiency.

BACKGROUND ART

A LED (Light Emitting Diode) is an element for converting electric signals to infrared light or light using the properties of compound semiconductor. LEDs, unlike a fluorescent light, has less induction factors causing environmental pollution since toxic substance such as mercury is not used, and has a longer lifetime, compared to prior light sources. LEDs also consume less electric power, compared to prior light sources and have a better visibility and less dazzling due to a high color temperature.

Accordingly, lighting lamps nowadays have been developed from the conventional light sources such as incandescent bulbs or fluorescent lamps to LEDs as a light source.

Especially, in the field of lighting lamps adopting LEDs studies of a heat sink configuration to radiate heat accompanied by emitting light had been proceeding, and as a result a lighting lamp configuration for improving heat radiation efficiency was disclosed in Korean Patent Registration Number 10-0943074.

FIG. 1 is a view showing a heat sink configuration of a prior lighting lamp. Referring to FIG. 1, a prior lighting lamp 1 includes a heat sink 10 and a globe 30 connected on the upper part of the heat sink 10. Here, the heat sink includes a plurality of heat sink fins 13 formed on an outer peripheral surface of a heat sink plate 11 and radiates heat produced from a LED mounted on the heat sink plate 11. However, the prior lighting lamp 1 as configured in the forgoing has drawbacks that the surrounding air flow formed from LED heat emitting does not proceed to the inner area of heat sink 10 formed between the heat sink plates 13, since a heat transfer flow path is not formed on the globe 30, and thus efficient heat dissipation performed through heat transfer is not carried out.

DISCLOSURE

Technical Problem

The present invention, as proposed to solve the drawbacks described above, has an object to provide a lighting lamp which may improve the heat dissipation efficiency. The lighting lamp includes a heat sink on an outer peripheral surface of which a first heat transfer flow path are formed, a light emission module formed on the upper plane of the heat sink and provided with at least one light emission element, and a globe connected to the upper part of the heat sink and covering the light emission module wherein an outer peripheral surface of the globe includes a second heat transfer flow path corresponds to the first heat transfer flow path.

Solution to Problem

The lighting lamp of the present invention may include a heat sink on an outer peripheral surface of which the first heat transfer flow path are formed, a light emission module formed on the upper part of the heat sink and provided with at least one light emission module, and a globe connected to the upper part of the heat sink and covering the light emission element wherein the outer peripheral surface of the globe are formed of the second heat transfer flow path corresponds to the first heat transfer flow path. Especially, the second heat transfer flow path is desirable to match with the first heat transfer flow path when the heat sink and the globe are connected as it is provided on the position which corresponds to the first heat transfer flow path among the outer peripheral surface of the globe.

According to the lighting lamp of the present invention, the heat sink may include a heat sink plate, a plurality of heat sink fins which is longitudinally formed on the outer peripheral surface of the heat sink plate, wherein the first heat transfer flow path may be formed as a concave between the fins.

According to the lighting lamp of the present invention, the fins are desirable to be formed on a protrusion part between the first heat transfer flow paths.

According to the lighting lamp of the present invention, the globe may include a plurality of a protrusion configuration longitudinally formed on the outer peripheral surface and the second heat transfer flow path may be formed as a concave produced between the protrusions.

According to the lighting lamp of the present invention, the globe may be made of any one of Polycarbonate, Acrylic resin, Acrylonitrile Butadiene Styrene resin, Engineering Plastics and Styrene-Acrylonitrile.

According to the lighting lamp of the present invention, a cross section of the globe may be shaped as a hemispherical form.

According to the lighting lamp of the present invention, the globe may be connected on the upper part of the heat sink by means of adhesive materials.

According to the lighting lamp of the present invention, the heat sink may be made including any of Al, Mg and an alloy thereof.

According to the lighting lamp of the present invention, the light emission module may be Surface Mount Device module (SMD) or chip on board, and a light emission element provided on the light emission module may be used of LEDs.

The lighting lamp of the present invention may include a socket connected to a lower part of the heat sink to supply power source.

Advantageous Effects of Invention

According to the present invention, the heat transfer area is increased and the heat dissipation efficiency is improved by smoothly proceeding to the air flow toward the inner part of the heat sink.

Further, according to an embodiment of the present invention, the life shorting of a LED is avoided due to the improvement of the heat dissipation efficiency and as a result, the reliability of the lighting lamp is improved.

BRIEF DESCRIPTION OF DRAWINGS

The above and other aspects, features and advantages of certain exemplary embodiments of the present invention will be more apparent from the following description taken in conjunction with the accompanying drawings, in which.

MODE FOR THE INVENTION

Figure 1:
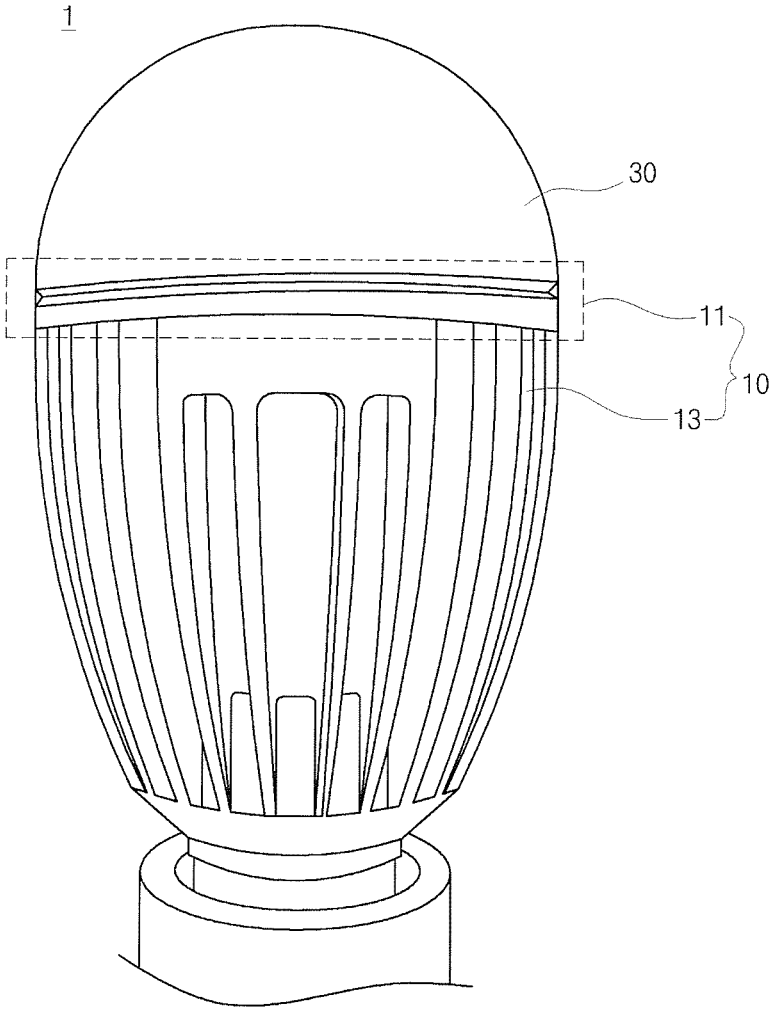
FIG. 1 is a view showing a configuration of a heat sink of a prior lighting lamp.

Hereinafter, exemplary embodiments of the present invention will be described with reference to the accompanying drawings. It should be understood that the configurations described herein and illustrated in the drawings are merely the embodiments of the present invention and may be replaced by various modifications as of the time when the application is filed. Further, in the following description of the present invention, a detailed description of known functions and configurations incorporated herein will be omitted when it may make the subject matter of the present invention rather unclear. The following terms are defined, considering their functions in the prevent invention, and should be construed based on the entire contents of the specification. The same or like reference numerals denote the element performing the same or like functions and operations through the specification.

Figure 2:
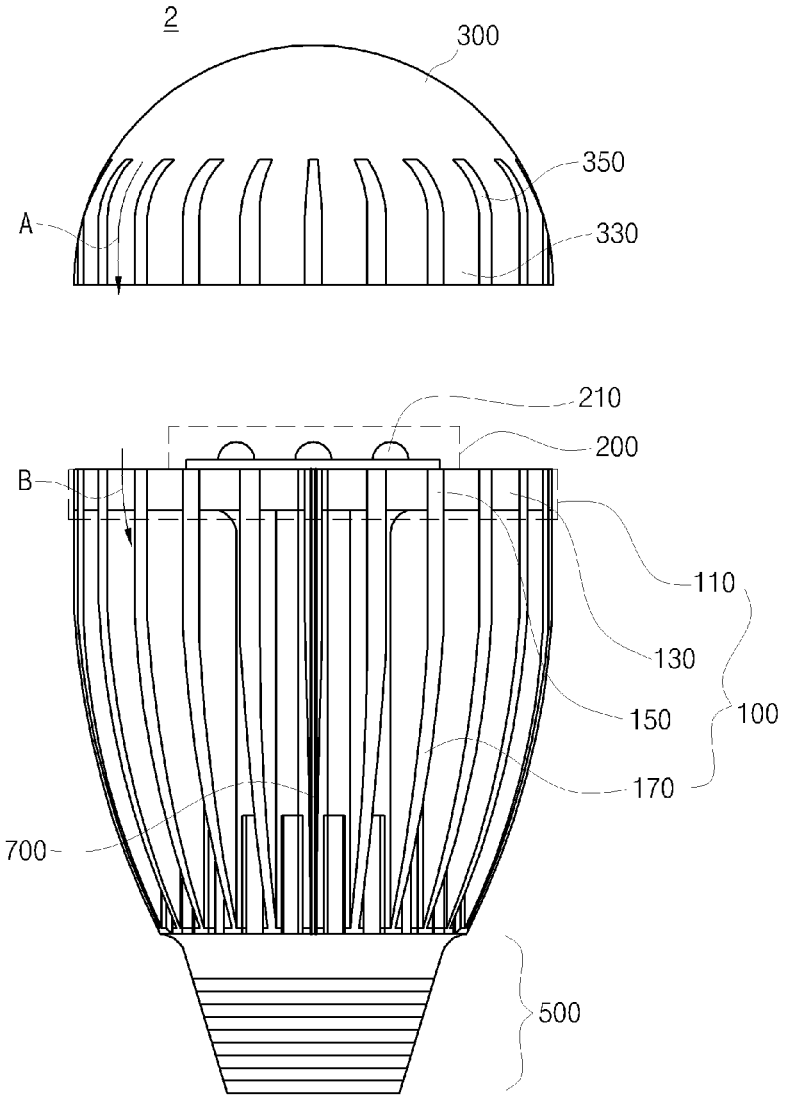
FIG. 2 is a cross-sectional view showing the lighting lamp according to the present invention.

FIG. 2 is a cross-sectional view showing a lighting lamp according to the present invention.

Referring to FIG. 2, the lighting lamp 2 according to the present invention includes a heat sink 100, a light emission module 200 placed on an upper surface of the heat sink 100 and provided with at least one light emission element 210, and a globe 300 connected to an upper part of the heat sink 100 and covering the light emission module 200 wherein a socket 500 for supplying power source is further provided on a lower part of the heat sink 100. At this time, a first heat transfer flow path B is provided on an outer peripheral surface of the heat sink 100 and a second heat transfer flow path A is provided on the outer peripheral surface of the globe 300 connected to an upper part of the heat sink 100, corresponding to the first heat transfer flow path B. At this time, the second heat transfer flow path A may be provided on a position among the outer peripheral surfaces of the globe 300, which matches with the first heat transfer flow path B, and thus the flow paths connected as a uniform route may be formed. It intends to make smoothly the heated air pass by and improve further the heat dissipation efficiency by aligning convection courses of air heated from light emission module 200. Here, the heat transfer flow path refers to a way through which an air flow made by convection of surrounding air produced from the heating of the light emission module 200 proceeds.

The socket 500 refers to a socket for a lighting lamp of a typical configuration, and a power source is applied through the socket 500 and is supplied to the light emission module 200.

The heat sink 100 according to the present invention includes a heat sink plate 110 on which a light emission module is mounted and a plurality of heat dissipation fins 170 formed on the outer peripheral surface of the heat sink plate 110.

Meanwhile, a concave part 130 is formed inward in a space between the heat dissipation fins 170 among the outer peripheral surfaces of the heat sink plate 110 and a protrusion part 150 is formed outward on the part on which the heat dissipation fins 170 are provided. As a result, the first heat transfer flow path B is produced in the concave part 130, and thus the air heated by the emitting heat from the light emission element 200 can proceeds easily to the inner part of the heat sink 100, more specifically, to the space between heat dissipation fins 170 through convection. As a result, the heat dissipation efficiency is improved by enlarging contact area of the heated air and the heat dissipation fins 170.

The heat sink 100 as configured in the forgoing may be made including any of Al, Mg or alloy thereof having excellent heat conductivity and may be produced by die casting. However, this is just an exemplary embodiment, and thus the heat sink 100 according to the present invention may be made of polymer having excellent heat conductivity through injection molding.

Meanwhile, a hole passing through vertically may be provided on the inner part of the heat sink 100 and a space in which electric wire 700 connected to the light emission module 200 is arranged, may be provided.

The light emission module 200 serves to emit light when power is supplied as a module on which at least one light emission element 210 is mounted. Especially, in the present invention, the light emission element 210 may be LEDs (Light Emitting Diodes).

Meanwhile, the light emission module 200 according to the present invention may be a SMD module including a Surface Mount Device (SMD) package on a substrate thereof, or a Chip On Board (COB) module on which a plurality of light emission elements are densely arranged and mounted, or the like, and the COB module may be more preferable, but it is not limited thereto.

Generally in the case of the COB module, high powered light emitting is available with a single light emitting part. However, temperature of the light emission element rises high easily since a plurality of light emission elements are densely arranged and mounted on the light emitting part. Thus, a lifespan of the light emission element is shortened and light emission power is lowered. However, the lighting lamp according to the present invention, the heat dissipation efficiency is improved as the heat transfer flow path is provided, and even if the light emission module 200 is provided as a COB module, a stable heat dissipation ability is ensured and further the shortening lifespan of the light emission element and the light emission power decreasing can be avoided.

The globe 300 according to the present invention is connected to an upper part of the heat sink 100 to cover the light emission module 200, and is shaped as a dome form with a hemispherical cross-section.

Meanwhile, a connection of the globe 300 and the heat sink 100 may be made through a adhesive material to avoid humidity being input and to improve the rigidity of the lighting lamp, however, it is not limited thereto, all kinds of connection type such as a screw connection type could be used from what is available commercially in a market or will be implemented in the future as technology is progressed.

The globe 300 according to the present invention may be made of synthetic resin or glass with excellent light permeability and light diffusion property. Especially, the globe 300 according to the present invention may be made of any one of Polycarbonate, Acrylic resin, Acrylonitrile Butadiene Styrene resin, Engineering Plastics and Styrene-Acrylonitrile through injection molding, and more preferably, the globe may be made of Polycarbonate, but it is not limited thereto.

Meanwhile, the globe 300 according to the present invention may have a concave part 330 inward from the outer peripheral surface thereof and a plurality of protrusions 350 may be formed longitudinally along the outer peripheral surface between the concave parts 330. Further, the second heat transfer flow path A may be provided in the concave part 330 as a space between the protrusions 350. As a result, the concave part 330 formed on the globe 300 matches with the concave part 130 formed on the heat sink 100 when the globe 300 is connected on an upper part of the heat sink 100. In addition, the protrusion 350 formed on the globe 300 matches with the protrusion part 150 formed in the heat sink 100 and the heat dissipation fins 170 formed on the protrusion part 150, and thus the first heat transfer flow path B of the heat sink 100 matches with the second heat transfer flow path A of the globe 300.

As a result, the air heated by heat emitted from the light emission element 200 can proceed easily to the inside of the heat sink 100, more specifically, to the space between the heat dissipation fins 170, along the second heat transfer flow path A formed on the globe 300 and the first heat transfer flow path B formed on the heat sink 100 through convection, and thus the contact area of the heated air and the heat sink 100 is enlarged to improve the heat dissipation efficiency.

Figure 3:
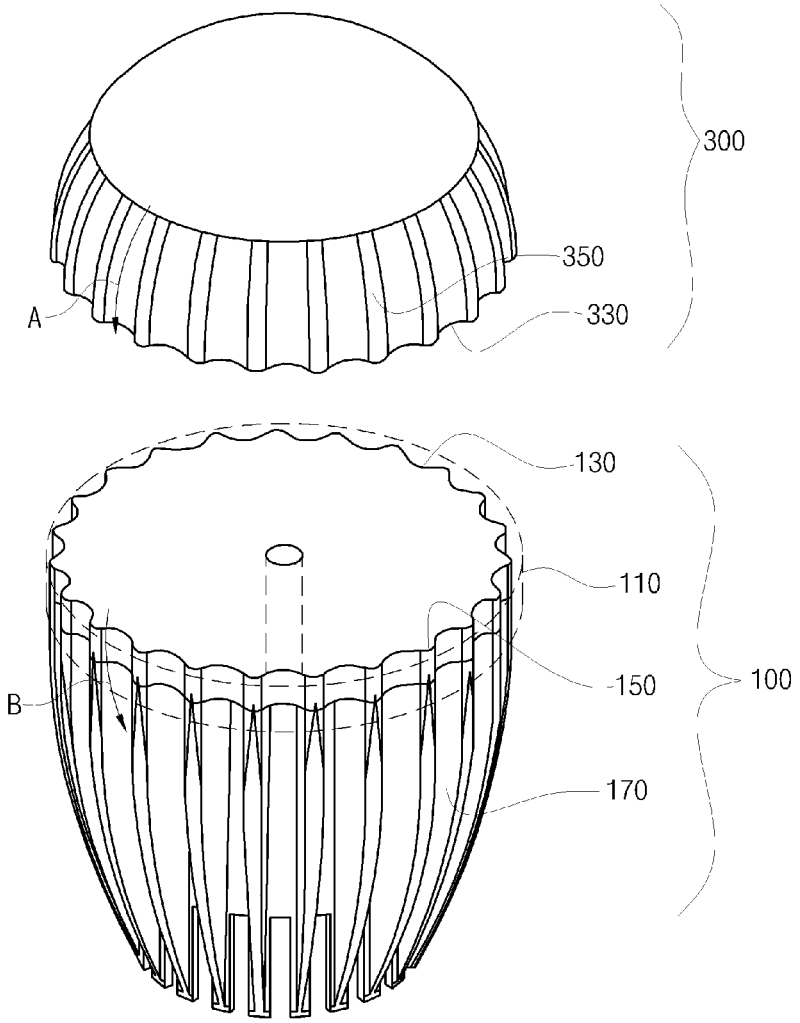
FIGS. 3 and 4 are exploded perspective views showing a heat sink and a globe according to an embodiment of the present invention.
Figure 4:
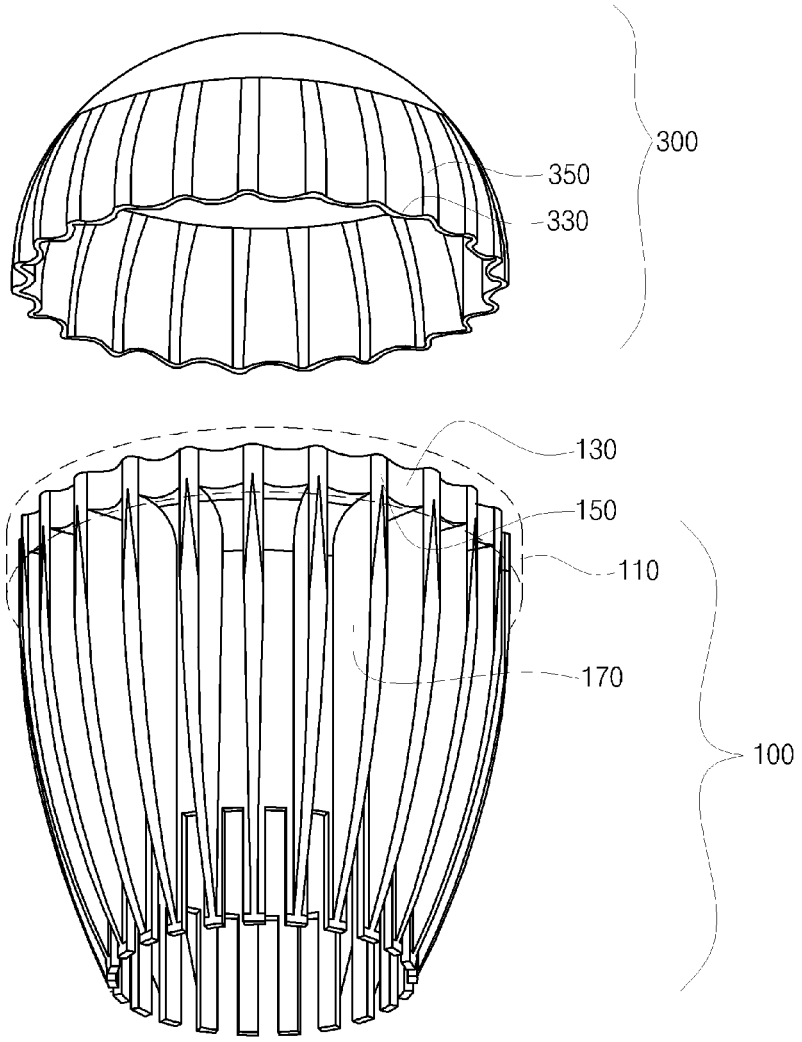
Figure 5:
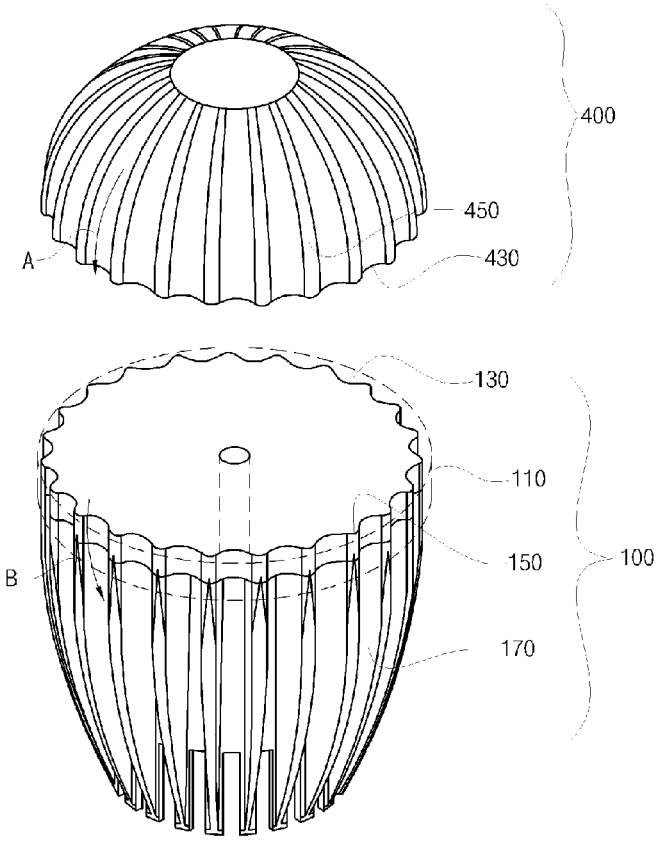
FIG. 5 is an exploded perspective view showing of a heat sink and a globe of a lighting lamp according to another embodiment of the present invention.

FIGS. 3 and 4 are exploded perspective views showing a heat sink and a globe according to an embodiment of the present invention, and FIG. 5 is an exploded perspective view showing of a heat sink and a globe of a lighting lamp according to another embodiment of the present invention.

Referring to FIGS. 3 and 4 and FIG. 5, as described in FIG. 2, the heat sink 100 according to the present invention may include the heat sink plate 110, a plurality of concave parts 130 formed on an outer the outer peripheral surface of the heat sink plate 110 and the heat dissipation fins 170 provided on the protrusion part 150 between concave parts 130, and further the first heat transfer flow path B is formed along the concave part 130.

A plurality of the protrusions 350 may be provided on an outer peripheral surface of the globe 300 as described in FIGS. 3 to 5, the concave part 330 is provided between the protrusions and the second heat transfer flow path A is formed on the concave part. Further, the globe 300 may be shaped as a hemispherical form of hollow body, as illustrated in FIG. 4.

Especially, the globe 300 according to an embodiment of the present invention may be configured as the concave part 300 and the protrusion 350 formed on an outer peripheral surface of the globe are formed not to the central part of the globe 300 but to the partial part except the central part as illustrated in FIGS. 3 and 4.

Meanwhile, the globe 400 according to another embodiment of the present invention as shown in FIG. 5, differently from the globe 300 illustrated in FIGS. 3 and 4, may be configured such that the concave part 430 and the protrusion 450 formed on the outer peripheral surface of the globe 400 is extended to the central part as illustrated in FIG. 5. In addition to this, the descriptions of the configurations of the globe 400 and the heat sink 100 are omitted since they are same as those described in FIGS. 2 to 4.

Figure 6:
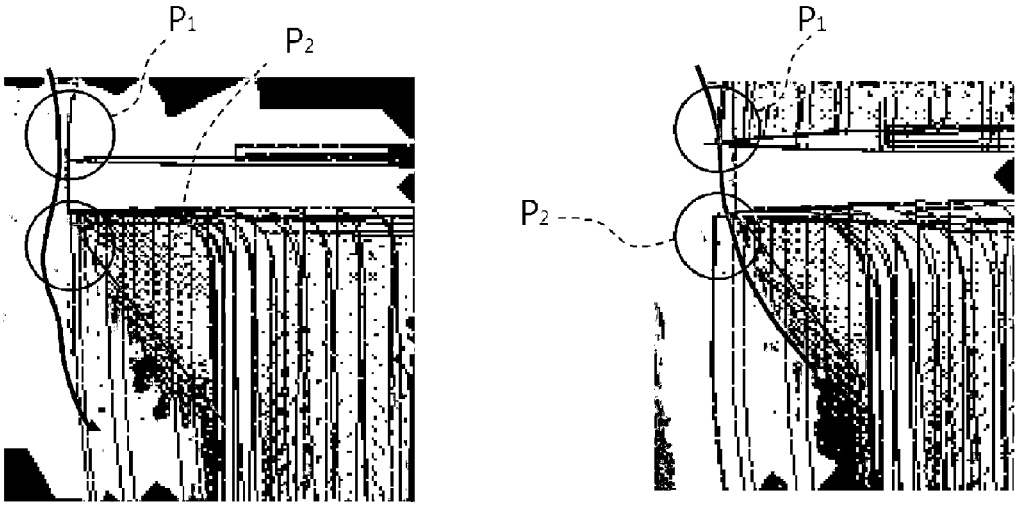
FIG. 6 is a view showing heat transfer analysis result for a prior lighting lamp and the lighting lamp according to the present invention.

FIG. 6 is a view showing heat transfer analysis result for a prior lighting lamp and the lighting lamp according to the present invention.

Referring to FIG. 6, in the case of the prior lighting lamp, the globe is not provided with the protrusion and the concave part, and thus the second heat transfer flow path according to the present invention is not formed, as shown in FIG. 6(*a*). Further, the concave part is not formed on an outer peripheral surface of the heat sink and thus the heat transfer flow path on a heat sink is also not provided. As a result, it is verified that air heated by heat emitted from the light emission element does not easily proceed to the space between heat dissipation fins, as shown in the parts of P1 and P2. On the contrary, in the case of the lighting lamp according to the present invention, heated air easily proceeds to the space between heat dissipation fins as the heat transfer flow path is provided on the globe and the heat sink as shown in FIG. 6(*b*).

As a result, it can be verified that the lighting lamp according to the present invention has an effect that heat dissipation area is enlarged and heat dissipation efficiency is improved.

While the invention has been shown and described with reference to exemplary embodiments thereof, it will be understood by those skilled in the art that various changes in form and details may be made therein without departing from the spirit and scope of the invention as defined by the appended claims. Therefore, the scope of the invention is defined not by the detailed description of the invention but by the appended claims, and all differences within the scope will be construed as being included in the present invention.

The invention claimed is:

1. A lighting lamp comprising:

a light emission module provided with at least one light emission element;

a heat sink housing the light emission module, having a first heat transfer flow path on an outer peripheral surface thereof and emitting heat energy of the light emission module; and a globe connected to the heat sink to cover the light emission module exposed on the heat sink and provided with a second heat transfer flow path on an outer peripheral surface thereof to guide air heated by the light emission module toward the outer peripheral surface of the heat sink.

2. The lighting lamp of claim 1, wherein the second heat transfer flow path is connected to the first heat transfer flow path.

3. The lighting lamp of claim 1, wherein the heat sink comprises:

a heat sink plate connected to the globe; and a plurality of heat dissipation fins connected to the heat sink plate and extended from the heat sink plate in the opposite of a side facing to the globe wherein the first heat transfer flow path is provided with a concave part between the plurality of heat dissipation fins.

4. The lighting lamp of claim 3, wherein the plurality of heat dissipation fins comprise a protrusion part between the first heat transfer flow paths.

5. The lighting lamp of claim 1, wherein the globe includes a plurality of protrusions extended on the outer peripheral surface thereof toward the heat sink and the second heat transfer flow path is provided with a concave part between the plurality of protrusions.

6. The lighting lamp of claim 1, wherein the globe comprises any one of Polycarbonate, Acrylic resin, Acrylonitrile Butadiene Styrene resin, Engineering Plastics and Styrene-Acrylonitrile.

7. The lighting lamp of claim 1, wherein a cross section of the globe is shaped as a hemispherical form.

8. The lighting lamp of claim 1, further comprising an adhesive material between the globe and the heat sink.

9. The lighting lamp of claim 1, wherein a material of the heat sink includes any of Al, Mg, and an alloy thereof.

10. The lighting lamp of claim 1, wherein the light emission module is a Surface Mount Device (SMD) module or chip on board (COB) module, the SMD or COB module is provided with the light emission element mounted on a printed circuit board.

11. The lighting lamp of claim 10, wherein the light emission element is a LED device.

12. The lighting lamp of claim 10, further comprises a socket connected to the heat sink to supply power source to the light emission element.

13. The lighting lamp of claim 5, wherein the second heat transfer flow path is extended between an end part of the globe facing to the heat sink and a central part of the globe positioned in the opposite side of the end part.

14. The lighting lamp of claim 13, wherein a radius of an inscribed or circumscribed circle of the central part is smaller than half the radius of an inscribed or circumscribed circle on the end part of the globe.

* * * * *